US005953771A

United States Patent [19]

VanHuss

[11] Patent Number: 5,953,771

[45] Date of Patent: Sep. 21, 1999

[54] SLIDABLE, MAGNETICALLY BIASED SHOWER CURTAIN CLIP

[76] Inventor: Gloria J. VanHuss, 14567 Fruitville Rd., Sarasota, Fla. 34240

[21] Appl. No.: 09/251,858

[22] Filed: Feb. 17, 1999

[51] Int. Cl.[6] ..... A47K 3/22

[52] U.S. Cl. ..... 4/609; 4/605; 16/320; 16/DIG. 14

[58] Field of Search ..... 4/609, 608, 607, 4/610, 605, 597; 16/319, 320, DIG. 14

[56] References Cited

U.S. PATENT DOCUMENTS

| | | | |
|---|---|---|---|
| 3,000,016 | 9/1961 | Ridge | 4/149 |
| 3,107,361 | 10/1963 | Glutting, Sr. | 4/149 |
| 3,282,328 | 11/1966 | Mushro et al. | 160/349 |
| 3,365,684 | 1/1968 | Stemke et al. | 335/302 |
| 4,594,741 | 6/1986 | Payne | 4/558 |
| 4,723,326 | 2/1988 | Tarlow et al. | 4/608 |
| 4,887,324 | 12/1989 | Cairns | 4/609 |
| 5,787,520 | 8/1998 | Dunbar | 4/609 |

*Primary Examiner*—David J. Walczak
*Attorney, Agent, or Firm*—Joseph N. Breaux

[57] ABSTRACT

A slidable, magnetically biased shower curtain clip that is slidable along a bottom edge of a shower curtain without having to detach the clip from the shower curtain. The shower curtain clip includes first and second clip assemblies hingedly connected together. Each clip assembly includes a molded plastic clip member and two rows of spherical magnetic balls, snap inserted and roliably entrapped within ball holding structures molded into the clip member.

1 Claim, 2 Drawing Sheets

SLIDABLE, MAGNETICALLY BIASED SHOWER CURTAIN CLIP

TECHNICAL FIELD

The present invention relates to curtain securing devices and more particularly to a slidable, magnetically biased shower curtain clip that is slidable along a bottom edge of a shower curtain without detaching the clip; the slidable, magnetically biased shower curtain clip including first and second clip assemblies hingedly connected together; each clip assembly including a molded plastic clip member and two rows of spherical magnetic balls, snap inserted and rollably entrapped within ball holding structures molded into the clip member; the first and second clip assemblies being hingedly connected by a hinge such that the first and second clip assemblies are pivotable together such that each of the spherical magnetic balls of the first clip assembly contacts and magnetically attracts a spherical magnetic ball of the second clip assembly.

BACKGROUND ART

Shower curtains are often used to prevent water from flowing onto the floor when showering. Although shower curtains perform well, it would be desirable to have weighted clips that would be securable to the bottom edge of a shower curtain to maintain the shower curtain material in place and, thereby, prevent water from flowing onto the floor.

GENERAL SUMMARY DISCUSSION OF INVENTION

It is thus an object of the invention to provide a slidable, magnetically biased shower curtain clip.

It is a still further object of the invention to provide a slidable, magnetically biased shower curtain clip that includes first and second clip assemblies hingedly connected together; each clip assembly including a molded plastic clip member and two rows of spherical magnetic balls, snap inserted and rollably entrapped within ball holding structures molded into the clip member; the first and second clip assemblies being hingedly connected by a hinge such that the first and second clip assemblies are pivotable together such that each of the spherical magnetic balls of the first clip assembly contacts and magnetically attracts a spherical magnetic, ball of the second clip assembly.

It is a still further object of the invention to provide a slidable, magnetically biased shower curtain clip that accomplishes all or some of the above objects in combination.

Accordingly, a slidable, magnetically biased shower curtain clip is provided. The slidable, magnetically biased shower curtain clip includes first and second clip assemblies hingedly connected together; each clip assembly including a molded plastic clip member and two rows of spherical magnetic balls, snap inserted and rollably entrapped within ball holding structures molded into the clip member; the first and second clip assemblies being hingedly connected by a hinge such that the first and second clip assemblies are pivotable together such that each of the spherical magnetic balls of the first clip assembly contacts and magnetically attracts a spherical magnetic ball of the second clip assembly.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
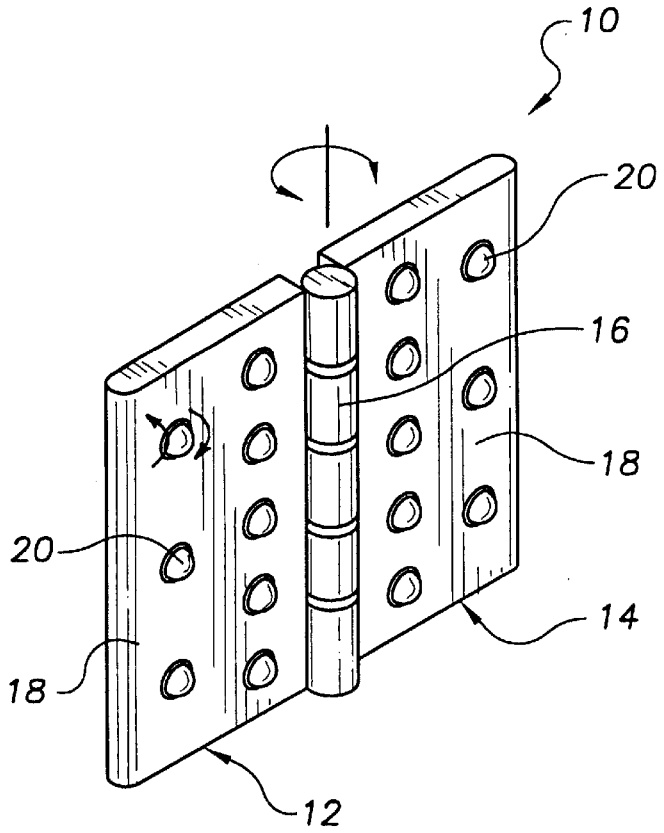
FIG. 1 is a perspective view of an exemplary embodiment of the slidable, magnetically biased shower curtain clip of the present invention showing the first and second clip assemblies hingedly connected together; each clip assembly including a molded plastic clip member and two rows of spherical magnetic balls, snap inserted and reliably entrapped within ball holding structures molded into the clip member; the first and second clip assemblies being hingedly connected by a hinge such that the first and second clip assemblies are pivotable together such that each of the spherical magnetic balls of the first clip assembly contacts and magnetically attracts a spherical magnetic ball of the second clip assembly.
Figure 2:
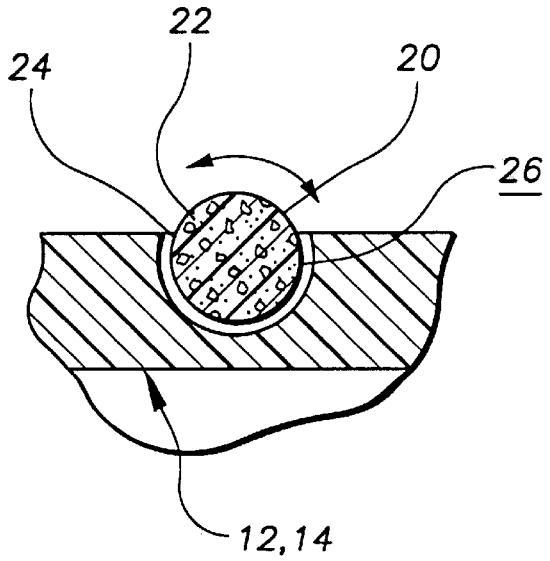
FIG. 2 is a cross section view showing one of the spherical magnetic balls snap inserted and rollably entrapped within one of the ball holding structures molded into one of the clip members.

FIG. 1 is a perspective view of an exemplary embodiment of the slidable, magnetically biased shower curtain clip of the present invention generally designated 10. Shower curtain clip 10 includes first and second clip assemblies, generally designated 12,14, that are hingedly connected together with a plastic hinge 16. Each clip assembly 12,14 includes a molded plastic clip member 18 and two rows of spherical magnetic balls 20. With reference now to FIG. 2, magnetic bails 20 are constructed of a rubber material 22 impregnated with barium ferrite particles 24 and are each snap inserted and rollably entrapped within one of a corresponding number of greater than half spherical ball holding structures 26 molded into each clip member 12,14.

Figure 3:
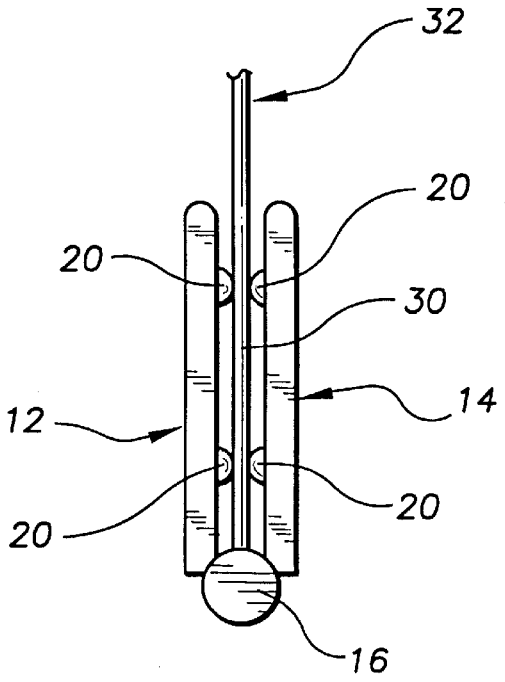
FIG. 3 is a side plan view showing the bottom edge of a representative shower curtain positioned between the pivoted together first and second clip assemblies with the first and second clip assemblies biased together by magnetic forces from the spherical magnetic balls to grip the shower curtain.
Figure 4:
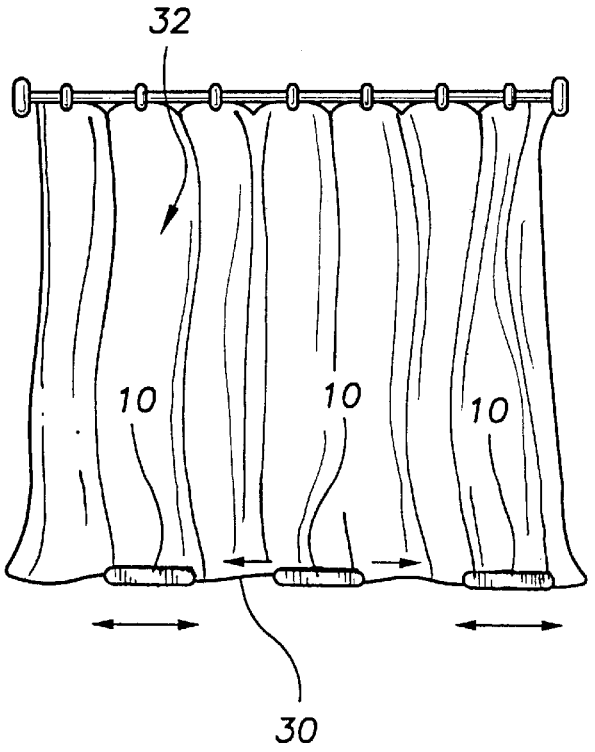
FIG. 4 is a front plan view showing three of the exemplary slidable, magnetically biased shower curtain clips of FIG. 1 slidably secured to a bottom edge of the representative shower curtain.

Referring now to FIG. 3, first and second clip assemblies 12,14 are hingedly connected by plastic hinge 16 such that each of the spherical magnetic balls 20 of first clip assembly 12 contacts and magnetically attracts a spherical magnetic ball 20 of second clip assembly 14 when first and second clip assemblies 12, 14 are pivoted together. In use, a bottom edge 30 of a shower curtain, generally designated 32 is positioned between first and second clip assemblies 12,14 prior to pivoting them together. Referring now to FIG. 4, it is often desirable to use more than one curtain clip 10 to maintain bottom edge 30 in the proper position to prevent water leakage. Because magnetic balls 20 (FIGS. 1–3) are rollable, curtain clips 10 are slidable along bottom edge 30 without detaching. In addition, when curtain clips 10 are used with a shower curtain used in conjunction with a cast iron bath tub, the spherical magnetic balls 20 (FIGS. 1–3) are attracted and hold curtain clip 10 in place against the sidewall of the bathtub to provide addition protection from leaking.

It can be seen from the preceding description that a slidable, magnetically biased shower curtain clip has been provided that includes first and second clip assemblies hingedly connected together; each clip assembly including a molded plastic clip member and two rows of spherical magnetic balls, snap inserted and rollably entrapped within ball holding structures molded into the clip member; the first and second clip assemblies being hingedly connected by a hinge such that the first and second clip assemblies are pivotable together such that each of the spherical magnetic balls of the first clip assembly contacts and magnetically attracts a spherical magnetic ball of the second clip assembly.

It is noted that the embodiment of the slidable, magnetically biased shower curtain clip described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A slidable, magnetically biased shower curtain clip comprising:

a first clip assembly; and a second clip assembly hingedly connected to said first clip assembly;

each said first and said second clip assembly including a molded plastic clip member and two rows of spherical magnetic balls, snap inserted and rollably entrapped within ball holding structures molded into the clip member;

said first and said second clip assemblies being hingedly connected by a hinge such that said first and said second clip assemblies are pivotable together such that each of said spherical magnetic balls of said first clip assembly contacts and magnetically attracts a spherical magnetic ball of said second clip assembly.

* * * * *